US005265452A

United States Patent [19]

Dawson et al.

[11] Patent Number: 5,265,452

[45] Date of Patent: Nov. 30, 1993

[54] BOLT LOCK BOLT RETRACTOR MECHANISM

[75] Inventors: Gerald L. Dawson; Thomas R. Clark, both of Lexington, Ky.

[73] Assignee: Mas-Hamilton Group, Lexington, Ky.

[21] Appl. No.: 763,120

[22] Filed: Sep. 20, 1991

[51] Int. Cl.[5] ..... E05B 49/00

[52] U.S. Cl. ..... 70/278; 70/277; 70/190; 292/142

[58] Field of Search ..... 70/277, 278, 190, 276; 292/22, 160, 172, 142

[56] References Cited

U.S. PATENT DOCUMENTS

| | | | |
|---|---|---|---|
| 656,011 | 8/1900 | Carleton | 292/172 |
| 1,266,159 | 5/1918 | Rittmeyer | 70/190 |
| 2,082,806 | 6/1937 | Michel | 70/278 |
| 3,733,861 | 5/1973 | Lester | 70/153 |
| 3,926,021 | 12/1975 | Genest et al. | 70/278 |
| 3,971,977 | 7/1976 | Hirt et al. | 310/70 R |
| 4,248,068 | 2/1981 | Esser et al. | 292/142 |
| 4,384,465 | 5/1983 | Muus | 292/172 |
| 4,416,127 | 11/1983 | Gomez-Olea Naveda | 70/413 |
| 4,433,355 | 2/1984 | Chew et al. | 361/172 |
| 4,534,194 | 8/1985 | Aydin | 70/278 |
| 4,616,491 | 10/1986 | Genest | 70/278 |
| 4,912,460 | 3/1990 | Chu | 340/825.31 |
| 4,918,955 | 4/1990 | Kimura et al. | 70/277 |
| 5,061,923 | 10/1991 | Miller et al. | 70/278 |
| 5,069,923 | 10/1991 | Miller et al. . | |

FOREIGN PATENT DOCUMENTS

| | | | |
|---|---|---|---|
| 2500520 | 8/1982 | France . | |
| 2178476 | 2/1987 | United Kingdom | 70/278 |

*Primary Examiner*—Peter M. Cuomo
*Assistant Examiner*—Darnell M. Boucher
*Attorney, Agent, or Firm*—Laurence R. Letson

[57] ABSTRACT

A bolt retraction mechanism is descrbied that is enabled by an electronic signal to a stepper motor which causes the lock to be openable. The lock is internally powered by a generator operable by the operator. The operation of the generator is separate from the lock operations.

15 Claims, 2 Drawing Sheets

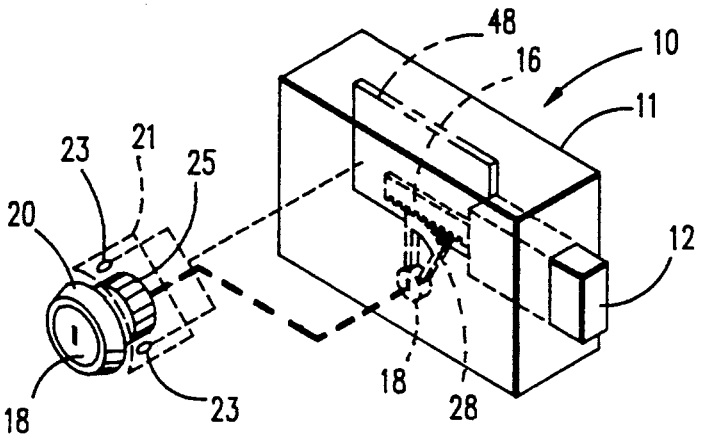
FIG. 1
FIG. 2
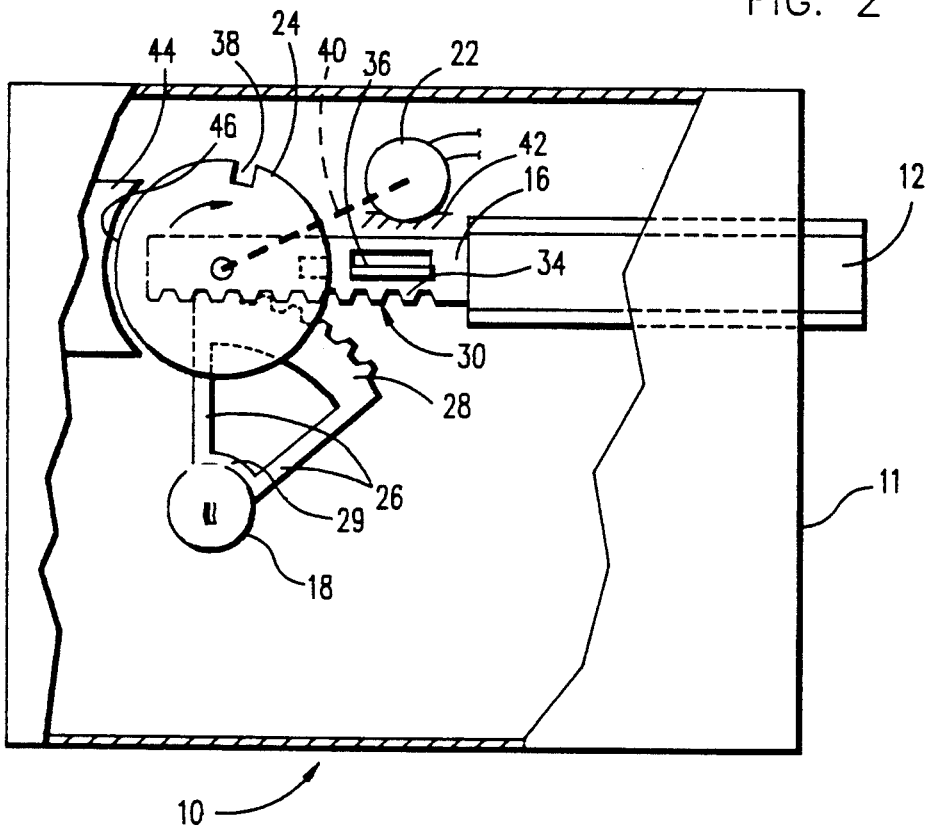
FIG. 6
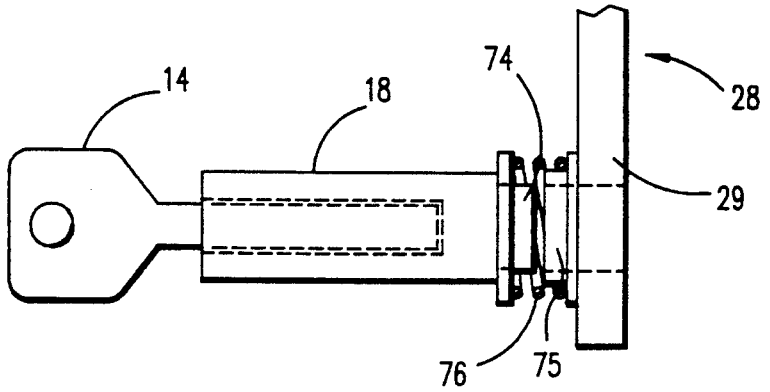

BOLT LOCK BOLT RETRACTOR MECHANISM

RELATED APPLICATION

The subject matter of this application is related to the subject matter of patent application Ser. No. 07/763,119, now U.S. Pat. No. 5,170,431, filed Sep. 20, 1991, on even date herewith by Gerald L. Dawson, et al., entitled Electronic Bolt Lock With Enhanced Security Features, and commonly assigned with this application to Mas-Hamilton Group, of Lexington, Ky.

FIELD OF THE INVENTION

This invention relates to bolt locks and more specifically to the bolt retractor mechanisms of electronic bolt locks.

BACKGROUND OF THE INVENTION

Bolt locks have been in existence for centuries. Only recently have the advent of electronic controls of locks developed. Mechanical bolt locks utilize the rotation of a key carrying thereon a physically contoured code surface to enable the lock and then the rotation of the key to withdraw the bolt of the lock from engagement with a strike or frame.

With the advent of self or internally generated electrical power to operate the electronic bolt locks, the key is not rotated to enable the lock. The key carries an electronic code that enables the lock when the electronic system of the lock is powered and the key is read or queried for its code. It is necessary to move some component of the lock device to cause the generation of the electrical power. One of the most obvious elements of the lock for movement would be the portion of the lock into which the key is inserted.

Since the rotation of the key to generate power for the operation of the lock electronics requires the movement of the key and the associated receptacle portion of the lock, the bolt withdrawal or retractor mechanism of the lock must not be engaged with the portion of the lock which is rotated to generate power; the bolt retractor mechanism must be engagable with the moveable portion of the lock on a selective, controlled basis to derive movement of the bolt from the movement of the lock parts such as the key receptacle.

SUMMARY OF THE INVENTION

It is an object of the invention to provide a control device to permit the rotation of the key in a bolt lock to power the lock and to connect the rotational movement of the key to the bolt retractor mechanism when the lock has verified that the key access code has been accepted by the lock.

It is another object of the invention to permit the movement of the key of a lock to perform some function not related to withdrawal of the lock bolt and to use the key movement to withdraw the lock bolt at a separate stage of the lock operation.

SUMMARY OF THE INVENTION

These objects of the invention and others are accomplished by an electrically controlled drive means that will engage the moveable elements moved with the rotation of the key of the bolt lock, with the bolt retractor to withdraw the bolt of the lock from the region of engagement with a strike or other blocking member of the opening being secured by the lock.

A stepper motor is pulsed and activated to cause the partial rotation of a gear to place it in position to mesh with another gear so that rotation of the key will be transmitted to the bolt retractor elements of the lock structure.

An alternative embodiment utilizes the capability of the stepper motor to rotate a blocking member so that the rotation of the key will withdraw the bolt when the key rotation positions a sector or partial gear in engagement with a rack of the bolt retractor.

The operation of the stepper motor is dependent upon signals from the electronic controls of the lock. If the signals are not received by the stepper motor, the motor will not rotate the blocking member to eliminate its influence in blocking the bolt retractor or the gear drive connection is not completed by the rotation of the idler gear.

A more complete understanding of the invention and the best mode for carrying out the invention will be attained by referring to the drawings and the detailed description to follow.

DESCRIPTION OF THE DRAWINGS

FIG. 1 is a diagrammatic representation of the lock.

FIG. 2 illustrates a bolt retraction and blocking mechanism.

FIG. 6 illustrates a selectively engagable drive connection between the key cylinder and the gear of the bolt retraction mechanism.

DETAILED DESCRIPTION OF THE BEST MODE FOR CARRYING OUT THE INVENTION

Figure 3:
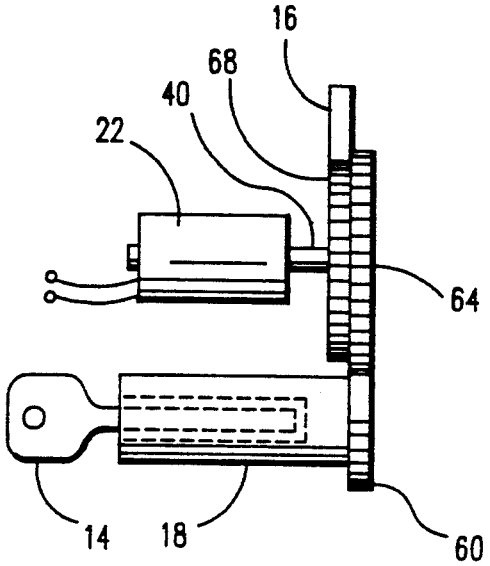
FIG. 3 is a side view of a gear train bolt retraction mechanism.

Electronic bolt locks such as that shown in FIG. 1 may be of the internally powered type where the operation of the lock 10 by the operator generates the power necessary to operate the electronic controls 48 of the lock 10 and the ancillary devices of the lock 10 required to unlock or operate the mechanical portion of the lock 10 structure.

Typically there are two choices of how the power may be generated in a bolt lock 10 of the type which uses a key 14 similar to the key for a mechanical tumbler and cylinder lock 25. First the rotation of the key 14 within the lock 10 will rotate the key cylinder 18 and any associated power generating devices, such as a segmented ring magnet or generator rotor. The generator 21 may be a stepper motor driven to generate pulses of electricity which in turn charges a capacitor.

The other choice of powering the lock 10 is to use the bezel 20 of the lock housing 11 as the rotational device to which the electrical generator 21 is connected.

If the bezel 20 is used as the driving element of the generation device, the rotation of the key 14 is not required to power the lock 10 and a continual or permanent mechanical drive connection between the key cylinder 18 and the bolt 12 is possible, if desired. In that case, the stepper motor 22 driven blocking wheel 24 may prove to be the most desirable. Referring to FIG. 1 key cylinder 18 is provided with at least a pair of spokes 26 that extend outwardly to support and move a sector gear 28. The sector gear 28 subtends an arc that is sufficiently long that with the movement of at least a portion of the sector gear teeth 34 past the point of mesh with rack 30 and the bolt 12 attached to the rack 30, will withdraw so that the end face of bolt 12 is flush with lock housing 11 or is slightly withdrawn within lock housing 11.

Bolt 12 is provided with an extension or bar 16. The extension or bar 16 is further provided with gear teeth 34 formed into one edge or surface of the bar 16 forming a rack 30. The axis of rotation of the key cylinder 18 is positioned such that the pitch circle of the sector gear 28 is tangent with the pitch line of the rack 30 for engagement of the gear and rack teeth 34.

The extension or bar 16 is further provided with a protruding member or tab which is referred to as a fence 36. The fence 36 may be formed as a part of the extension or attached by any conventional means.

A blocking wheel 24 is provided to block the fence 36 from movement. The axis of the blocking wheel 24 should be positioned to intersect the line of movement of the fence 36 when the bolt 12 is retracted or extended. The blocking wheel 24 is further provided with a notch 38 in its periphery sufficient in depth to accommodate the fence 36 within the notch 38 in its position correspondingly to the retracted position of the bolt 12. The radius of the blocking wheel 24 should be sufficient to prevent the fence 36 from allowing the withdrawal of the bolt 12 to a point that it may pass the strike or other blocking surface, which it is positioned to engage, when extended.

Since the blocking wheel 24 is mounted for rotation by stepper motor 22, the motor shaft 40 as well as the motor mountings 42 are not substantial in strength. To avoid the necessity of strengthened mountings 42 for the motor 22 or the shaft 40, a back-up shoe 44 is provided. The shoe 44 is formed to have a face 46 which will conform to the periphery of the blocking wheel 24. The face 46 displaced only slightly from the periphery of the blocking wheel 24 to permit free rotation of the blocking wheel 24 but closely enough that only a slight lateral displacement of the blocking wheel 24 will bring the wheel 46 periphery into contact with the face 46 of the shoe 44, thereby substantially increasing resistance to movement of the wheel in a translatory direction.

If the key 14 is rotated to bring the sector gear 28 into meshing engagement with the rack 30, and then further rotated to attempt to open the lock 10 by withdrawal of the bolt 12, the fence 36 will engage the outer periphery of the blocking wheel 24 and force it against the shoe 44, blocking the movement of the bolt 12. The bolt 12 of the lock 10 is extended to lock the bolt lock 10 by reversing the rotation of the key cylinder 18 until the bolt 12 is restored to the extended position. At that time the stepper motor 22 may be provided with a second signal to cause the motor 22 to step and rotate the blocking wheel 24 back into a blocking position.

Should sufficient power be available, a solenoid of the low-power variety, may be used with a lever arm to move the blocking wheel 24 to and from its unblocking position.

The sector gear 28 permits the rotation of the key 14 and the key cylinder 18 a significant portion of a single revolution without the engagement of and meshing of the sector gear 28 and the rack 30. Should a partial, for example one half, revolution of the key 14 and the associated rotation of the generator 21 be sufficient to create enough electrical energy to power the electronic controls 48 of the lock 10, the key 14 rotation may be used to power the lock 10, rather than the bezel 20.

An alternative embodiment will be described referring to FIG. 4. Where the rotation of the key 14 is desired as the powering activity for the electronic controls 48 of the lock 10 and a partial revolution of the key 14 and key cylinder 18 is not sufficient to generate the electrical power necessary, the key cylinder 18 may be connected directly or indirectly to a gear 60 having a segment 62 of its periphery removed or relieved. This gear 60 is then positioned at a meshing distance from a second gear 64 which similarly has a portion 66 of the gear periphery removed to permit the first gear 60 to rotate freely without meshing with the second gear 64.

Coupled with the second gear 64 is a third gear 68, which is rotated by the rotation of the second gear 64. The third gear 68 has a segment 70 of its periphery removed to allow the third gear 68 to disengage from the teeth 32 of rack 30. The rotational displacement relationship of the missing segments 66, 70 of the second gear 64 and third gear 68 is dependent upon the position of the first gear 60 connected to the key cylinder 18 on an arc about the axis of gear 64.

A stepper motor 22 is provided to rotate the second and third gears 64, 68 a partial revolution so that the teeth 72 of gear 68 mesh with the teeth 32 of rack 30, and the teeth 72 of gear 64 are positioned so that the further rotation of the key cylinder 18 and gear 60 will mesh gear 60 and gear 64. As can be seen, after meshing of gear 60 and gear 64, further rotation will act to withdraw bolt 12 by the translation of rack 30.

Reverse rotation of the key 14 and key cylinder 18 will result in the extension of bolt 12 and the ultimate disengagement of the gears 60, 64, 68 in the gear train.

Figure 4:
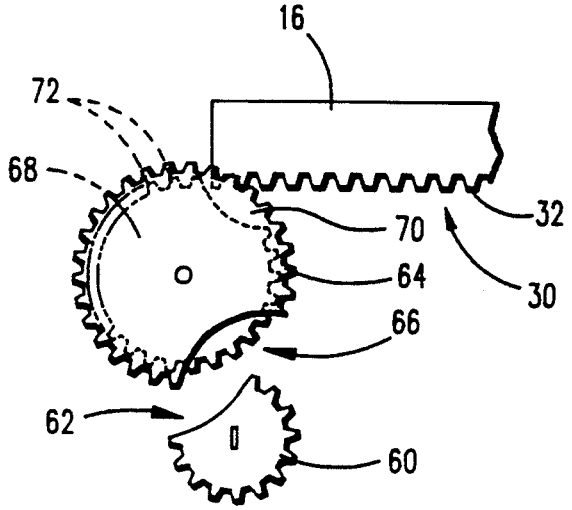
FIG. 4 is a rear view of a gear train bolt retraction mechanism.

The positions of the gears 60, 64, 68 are as shown in FIG. 4 when the lock 10 is locked and the bolt 12 extended and the electronic controls 48 are not active and the stepper motor 22 has not been pulsed or driven. Only a very small displacement of the second gear 64 and third gear 68 is necessary for the gears 64, 68 to be positioned for meshing of the key cylinder gear 60 and the second gear 64.

When the key 14 is rotated, the key cylinder 18 drives the generator 21 and the electronic controls 48 of the lock 10 determine that the key 14 in the key cylinder 18 is an authorized key 14, the stepper motor 22 will be provided at least one electrical pulse sufficient to rotate the motor shaft 40 and the second gear 64 and third gear 68 to the position that will result in the meshing of the key cylinder gear 60 with the second gear 64. Until such signal is provided to stepper motor 22, the key cylinder gear 60 may freely rotate without any engagement or interference with second gear 64.

An alternative arrangement for driving the sector gear 28 of FIG. 6 so that the key 14 may be rotated to drive the electrical generator 21 without displacing the sector gear 28 is shown in FIG. 6. The key cylinder 18 is contained within the lock housing 11 and is provided with a driving connection 74 projecting from the end of the key cylinder 18 and is coaxial with the key cylinder 18. Sector gear 28 is provided with a complementary driven connection 75 capable of accepting the driving connection 74 when the driving connection 74 is axially displaced. The key cylinder 18 may be biased by spring 76 to disengage from the sector gear 28. The spring 76 is positioned between the sector gear 28 and the key cylinder 18, in compression, or may engage the key cylinder 18 and some other element in tension to create the separating force.

If the key 14 is turned the driving connection 72 will not be engaged and the key cylinder 18 may rotate to generate the electricity needed to power the lock electronics. When the lock 10 has been powered, the driving connection 72 may be engaged to attempt to displace the sector gear 28 and ultimately the bolt 12, in an unlocking direction. By the operator pushing on the key 14 to displace the key 14 and the key cylinder 18 axially of the cylinder 18 against the spring 76 the key cylinder 18 engages the driven connection 72. As the key 14 is further rotated, the driving connection 72 and the driven connection 74 will align and mate to provide the connection.

To further safeguard the lock 10 against undue force being exerted on the key 14 to attempt to force the lock 10 to fail and the bolt 12 be withdrawn, the sector gear 28 may be fabricated with spokes 26 interconnecting the gear segment and the portion of the sector gear 28 forming the hub 29 in lieu of a solid plate. If the spokes 26 are properly sized, the spokes 26 will fail by deflection or breakage prior to the breaking of the fence 36. This arrangement of failure of the spokes 26 is applicable to both the case where the sector gear 28 is permanently attached to the key cylinder 18 and the case where the driving connection of FIG. 6 is utilized.

Figure 5:
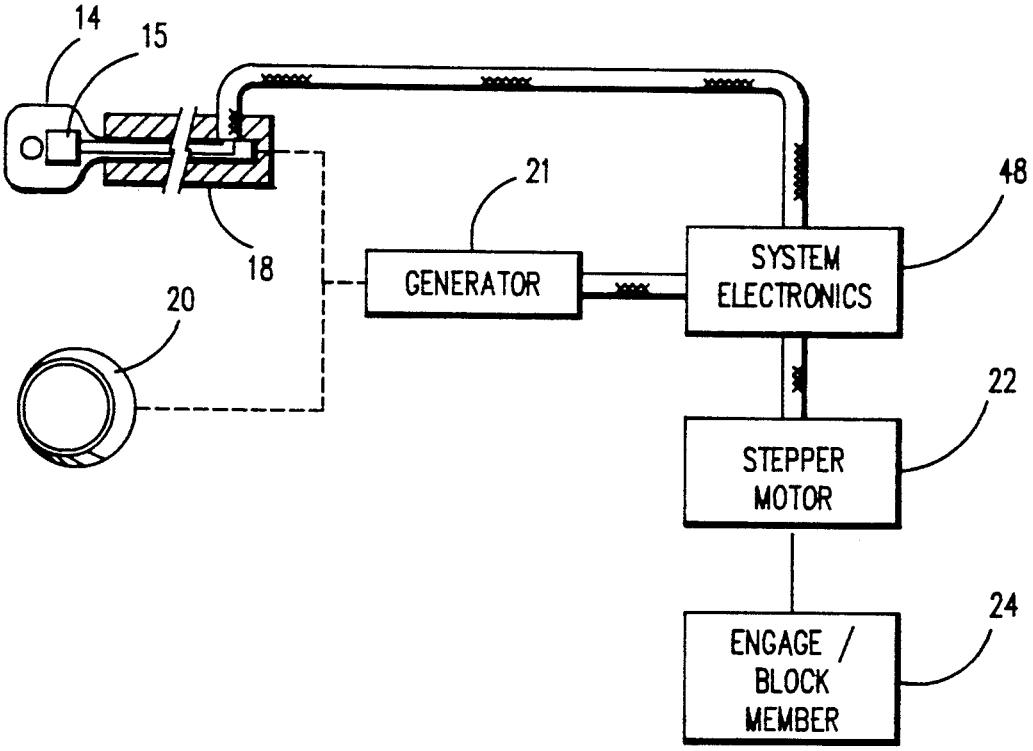
FIG. 5 is a block diagram of the electrical portions of the lock and the associated mechanical elements.

Such an arrangement is not necessary for the embodiment of FIG. 5 since the key 14 will rotate freely, with only the generator 21 providing resistance. Excessive force on the key 14 will not result in any possibility of forcing the lock 10 to retract the bolt 12.

The electronic controls 48 of the lock 10 are not critical to the invention. Only a signal need be provided to the stepper motor 22 to cause the stepper motor 22 to engage the gear train 60, 64, 68, 32 or rotate the blocking wheel 24, thereby permitting the operation of the lock 10 by rotation of the key 14 to withdraw the bolt 12. If desired, the control of the stepper motor 22 may be controlled remotely, with some loss of security.

While there has been a description of the best mode of carrying out the invention and alternative embodiments of the invention, it is understood that changes and modifications may be made to the invention by one of skill in the art without departing from the scope and spirit of the invention.

We claim:

1. An electronic bolt lock comprising:

a key carrying an electronically detectable access code;

electronic control means for detecting said access code and for determining said codes authenticity and for providing a signal for controlling operation of said lock;

self contained magneto generator means for providing electrical power to said electronic control means;

a bolt;

a manually rotatable means accessible to an operator of said lock;

said manually rotatable means drivingly connected to said magneto generator means for operating said generator;

a bolt retraction means for retracting said bolt into said lock comprising a manual force input means to provide force required to retract said bolt and an electrically controlled engagable force transmission means comprising a gear train, said gear train further comprising a plurality of toothed members, at least two of said toothed members being partial gears, each having a periphery with gear teeth disposed on only a portion of the periphery of said gears to transmit forces from said manual force input means to said bolt.

2. The lock of claim 1 wherein said manually rotatable means comprises a key and a key cylinder.

3. The lock of claim 1 wherein said manually rotatable means comprises a bezel surrounding said manual force input means.

4. The lock of claim 3 wherein said bezel carries internally of said lock, at least a magnetic member of said magneto generator means for movement relative to said lock by rotation of said bezel.

5. The lock of claim 4 wherein said magnetic member comprises a segmented ring magnet.

6. The lock of claim 1 wherein said engageable force transmission means comprises a rotary stepper motor.

7. An electronic bolt lock comprising:

electronic control means for authenticating an access code and providing an access control signal;

a key carrying said access code;

a self-contained electrical generating means for generating electrical power to power said electronic control means;

a manually operable means for operating said electrical generating means;

a bolt comprising a rack, movable from an extended position to a retracted position;

a manually operable force input means comprising a gear, for inputting to said lock, force necessary to retract said bolt;

a stepper motor responsive to said access control signal to rotate;

an enabling means for enabling said force to retract said bolt, comprising at least a pair of coaxial partial gears, a portion of said partial gears periphery devoid of gear teeth;

said stepper motor drivingly engaged with said enabling means to position said partial gears to mesh said partial gears with said gear of said force input means input means and with said rack, to be effective to connect said manually operable force input means to said bolt, upon receipt of said access control signal by said stepper motor, whereby said lock is enabled electrically to accept and utilize a manual input to operate said lock.

8. An electronic bolt lock comprising:

electronic control means for authenticating an access code and providing an access granting signal;

a bolt moveable from an extended position to a withdrawn position;

a manually operable power generation means for powering said lock;

a manually operable force input means comprising at least a partial gear for inputting force to said lock to operate said lock;

connecting means for connecting said manually operable force input means to said lock comprising a pair of partial gears, each having a periphery and said gears having teeth on only a portion of said gear periphery said pair of gears coaxially drivingly connected for concurrent movement;

a rotary stepper motor for selectively moving said connecting means to connect said manually operable force input means to said bolt, through said connecting means;

thereby transmitting force applied to said manually operable force input means to said bolt whereby said bolt may be moved from an extended position to a withdrawn position.

9. An electronic bolt lock comprising:

electronic control means for authenticating an access code and providing an access granting signal;

a bolt moveable from an extended position to a withdrawn position;

a manually operable power generation means for powering said lock;

a manually operable force input means for inputting force to said lock to operate said lock;

a connection means for connecting said manually operable force input means to said bolt, comprising a plurality of gears having a teeth on the periphery thereof, at least two of said gears being partial gears with a portion of said teeth removed, permitting disengagement with adjacent gear teeth;

a rotary stepper motor for selectively moving said connection means to connect said manually operable force input means to said bolt, thereby transmitting force applied to said manually operable force input means to said bolt whereby said bolt may be moved from an extended position to a withdrawn position, unlocking the bolt.

10. An electronic bolt lock comprising:

electronic control means for authenticating an access code and providing an access granting signal;

a bolt moveable from an extended position to a withdrawn position;

a manually operable power generation means for powering said lock;

a manually operable force input means for inputting force to said lock to operate said lock;

a connection means for connecting said manually operable force input means to said bolt, comprising a plurality of gears having teeth on the periphery thereof, at least two of said gears being partial gears with a portion of said teeth removed, permitting disengagement with adjacent gear teeth;

a rotary stepper motor for selectively moving said connection means to connect said manually operable force input means to said bolt, said stepper motor responsive to said access granting signal to rotate said connection means into an effective position for connecting;

thereby transmitting force applied to said manually operable force input means to said bolt whereby said bolt may be moved from an extended position to a withdrawn position, unlocking the bolt.

11. An electronic bolt lock comprising:

electronic control means for authenticating an access code and providing an access granting signal;

a bolt moveable from an extended position to a withdrawn position;

a manually operable power generation means for powering said lock;

a manually operable force input means for inputting force to said lock to operate said lock;

a connection means for connecting said manually operable force input means to said bolt including a pair of partial gears each having a periphery, said gears having teeth disposed on only a portion of said periphery, said pair of gears drivingly connected for concurrent movement;

a rotary stepper motor for selectively moving said connection means to connect said manually operable force input means to said bolt, thereby transmitting force applied to said manually operable force input means to said bolt whereby said bolt may be moved from an extended position to a withdrawn position, unlocking the bolt.

12. An electronic bolt lock comprising:

electronic control means for authenticating an access code and providing an access control signal;

a key comprising an electronically detectable access code;

a key cylinder for receiving said key and for connecting said key to said electronic control means;

a magneto-generator operable by said operator connected to said electronic control means for supplying power to said control means;

a gear drivingly connected to said key cylinder and rotatable by rotation of said cylinder, responsive to rotation of said key;

a bolt translatable from an extended position to a withdrawn position;

a rack drivingly associated with said bolt;

a rotary stepper motor, having a shaft, connected to and responsive to said electronic control means to rotate when an access control signal is received;

at least a partial gear having peripheral teeth, with portions of said teeth absent, mounted on said stepper motor shaft for rotation therewith;

said gear mounted on said motor shaft with said portions of said teeth absent proximate said gear connected to said key cylinder and said rack when said access control signal is not present and said bolt is in said extended position and rotated to present said peripheral teeth to said gear connected to said key cylinder and said rack when said access control signal is present.

13. The bolt lock of claim 12 wherein said partial gear comprises at least two partial gears, each having at least one portion of said teeth absent and said partial gears positioned relative to each other and said rack and said gear connected to said key cylinder that said partial gears are not meshed with said rack and said gear connected to said key cylinder when said access code is not present and said bolt is in said extended position.

14. The bolt lock of claim 13 wherein said magneto-generator is drivingly connected to a bezel surrounding said key cylinder, said bezel rotatable independently of said key cylinder, by said operator to power said lock.

15. The bolt lock of claim 13 wherein said magneto-generator is drivingly connected to said key cylinder and operable by rotation of said key cylinder without withdrawing said bolt.

* * * * *